US011267033B2

(12) United States Patent
Shiroishi et al.

(10) Patent No.: US 11,267,033 B2
(45) Date of Patent: Mar. 8, 2022

(54) MOLD AND METHOD FOR MANUFACTURING DRAWN CAN

(71) Applicant: TOYO SEIKAN GROUP HOLDINGS, LTD., Tokyo (JP)

(72) Inventors: Ryozo Shiroishi, Yokohama (JP); Kenichi Takao, Yokohama (JP); Takuho Kumagai, Yokohama (JP)

(73) Assignee: TOYO SEIKAN GROUP HOLDINGS, LTD., Tokyo (JP)

( * ) Notice: Subject to any disclaimer, the term of this patent is extended or adjusted under 35 U.S.C. 154(b) by 187 days.

(21) Appl. No.: 15/774,076

(22) PCT Filed: Nov. 22, 2016

(86) PCT No.: PCT/JP2016/084541
§ 371 (c)(1),
(2) Date: May 7, 2018

(87) PCT Pub. No.: WO2017/094556
PCT Pub. Date: Jun. 8, 2017

(65) Prior Publication Data

US 2018/0318900 A1 Nov. 8, 2018

(30) Foreign Application Priority Data

Dec. 1, 2015 (JP) ..... JP2015-234527

(51) Int. Cl.
*B21D 22/28* (2006.01)
*B21D 37/01* (2006.01)
(Continued)

(52) U.S. Cl.
CPC ..... *B21D 22/28* (2013.01); *B21D 28/14* (2013.01); *B21D 37/01* (2013.01); *B21D 37/205* (2013.01); *B21D 51/26* (2013.01)

(58) Field of Classification Search
CPC ..... B21D 22/20; B21D 22/21; B21D 22/22; B21D 22/28; B21D 22/30; B21D 22/286; B21D 51/26; B21D 37/01; B21D 37/18; B21D 37/205; B21D 24/04; B21D 24/16; B21D 28/02; B21D 28/18; B21D 28/145;
(Continued)

(56) References Cited

U.S. PATENT DOCUMENTS

2005/0150338 A1* 7/2005 Elynuik ..... B21D 28/34 83/13
2010/0116014 A1* 5/2010 Goda ..... H01M 2/0257 72/349
2014/0298878 A1* 10/2014 van de Liefvoort ... B21D 22/24 72/336

FOREIGN PATENT DOCUMENTS

JP 04-309418 A 11/1992
JP 5-138260 A 6/1993
(Continued)

OTHER PUBLICATIONS

Kobayashi—JP 2000/167625, Translated Feb. 24, 2020 (Year: 1998).*
(Continued)

*Primary Examiner* — Debra M Sullivan
(74) *Attorney, Agent, or Firm* — Sughrue Mion, PLLC

(57) ABSTRACT

A mold used for blanking a metal plate to shape a blank to be drawn. The mold has a surface treatment film and a top face to be brought into contact with the metal plate and a peripheral end face communicated indirectly with the top face. At least the top face is coated with the surface treatment film.

9 Claims, 6 Drawing Sheets

(51) Int. Cl.

| | |
|---|---|
| ***B21D 51/26*** | (2006.01) |
| ***B21D 37/20*** | (2006.01) |
| ***B21D 28/14*** | (2006.01) |

(58) Field of Classification Search

CPC ..... B21D 28/343; B21D 22/02; B21D 22/06; B21D 22/26; B21D 37/02; B21D 37/10; B21D 28/14; B21D 28/16; B21D 28/34

USPC ..... 72/347–351

See application file for complete search history.

(56) References Cited

FOREIGN PATENT DOCUMENTS

| | | | | | |
|---|---|---|---|---|---|
| JP | 8-90092 | A | | 4/1996 | |
| JP | 10287491 | A | * | 10/1998 | ..... C04B 41/009 |
| JP | 11-267769 | A | | 10/1999 | |
| JP | 2000-167625 | A | | 6/2000 | |
| JP | 2003-094121 | A | | 4/2003 | |
| JP | 2004-001034 | A | | 1/2004 | |
| JP | 2005-305510 | A | | 11/2005 | |
| JP | 2012-101257 | A | | 5/2012 | |

OTHER PUBLICATIONS

Koseki et al—JP 2005/305510, Translated Feb. 24, 2020 (Year: 2004).*

Yasuyuki et al—JP 2003/094121, Translated Feb. 24, 2020 (Year: 2001).*

Translation—Kodama et al—JP-10287491-A—Translated Feb. 24, 2020 (Year: 1998).*

Communication dated Jul. 4, 2019 from the European Patent Office in application No. 16870493.0.

"Development of boron-doped diamond-coated high toughness cemented carbide alloy tool for dry pressing" Research and Development Report, 2011, pp. 1-21.

International Search Report for PCT/JP2016/084541 dated Feb. 21, 2017 [PCT/ISA/210].

Communication dated Aug. 13, 2020, from the Japanese Patent Office in corresponding application No. 2016-226760.

* cited by examiner

ENLARGED VIEW OF PART A

ENLARGED VIEW OF PART B

MOLD AND METHOD FOR MANUFACTURING DRAWN CAN

CROSS-REFERENCE TO RELATED APPLICATION

This application is a National Stage of International Application No. PCT/JP2016/084541 filed Nov. 22, 2016, claiming priority based on Japanese Patent Application No. 2015-234527 filed Dec. 1, 2015.

TECHNICAL FIELD

The present invention relates to a mold used for shaping a blank to be drawn. More specifically, the present invention relates to a mold that is used for shaping a blank to be drawn and that has a peripheral end face communicated indirectly with a top face.

BACKGROUND ART

A metal can is usually manufactured by blanking a metal plate to a suitable shape for making a blank, and by subjecting the blank with working such as drawing. In blanking the metal plate, a blank-shaping punch (male mold) and a blank-shaping die (female mold) of desired shapes are prepared in advance. Then, the metal plate is set between the punch and the die, and either the punch or the die is moved to make the punch pass through the die.

Recently, demand for reducing frequency of mold maintenance, demand for improvement in press quality, demand for reducing loads on environment, restriction on chemical ingredients and the like have become more severe. In order to cope with such demand, there has been a necessity of imparting higher hardness or lubricity to a mold so as to decrease breakage in the mold during pressing or to decrease the amount of lubricant or to avoid use of lubricant.

For enhancing the hardness or lubricity of the mold, techniques to cover the mold surface with a surface treatment film of diamond or the like have been developed keenly. However, in the mold such as a blank-shaping punch or a blank-shaping die to be used for blanking a metal plate, a strong impact load may be applied to the cutting edge part. Further, the surface treatment film on the cutting edge part tends to be thicker due to the sharp shape of the cutting edge part. These factors may cause degradation in adhesiveness of the surface treatment film at the cutting edge part, and often results in chipping and scaling of the surface treatment film during polishing or pressing. When the surface treatment film has chipping and scaling, the chipping or scaling originates peeling of the surface treatment film that may progress even to other parts.

In order to solve the chipping and scaling problem, non-patent document 1 proposes diamond coating of a blank-shaping punch and a blank-shaping die both used for blanking a metal plate, where the punch and the die have chamfered corners. However, as specified in Non-patent document 1, the blank-shaping punch or the blank-shaping die having chamfered corners cannot effectively avoid peeling of the diamond film.

PRIOR ART DOCUMENTS

Non-Patent Documents

Non-patent document 1: Research and Development Report "Development of boron-doped diamond-coated high toughness cemented carbide alloy tool for dry pressing" in the year of 2011 by Strategic Core Technology Advancement Supporting Program

SUMMARY OF THE INVENTION

Problems to be Solved by the Invention

Therefore, an object of the present invention is to provide a mold used for blanking a plate material like a metal plate so as to shape a blank to be drawn, where progress of peeling of a surface treatment film on the mold is prevented or controlled effectively.

Means for Solving the Problems

The present invention provides a mold that can be used for blanking a plate material like a metal plate for shaping a blank to be drawn. The mold comprises a top face to be brought into contact with the plate material and a peripheral end face communicated indirectly with the top face, and at least the top face is coated with a surface treatment film.

It is preferable in the mold of the present invention that:

(1) the peripheral end face is located lower than the top face, thereby making the top face and the peripheral end face be communicated indirectly from each other;
(2) a groove is formed in a region between an outer edge of the top face and an inner edge of the peripheral end face, thereby making the top face and the peripheral end face be communicated indirectly from each other;
(3) a peripheral wall face lies between the top face and the peripheral end face;
(4) the top face and the peripheral end face are constituted of separate members;
(5) it is applicable further to drawing of the blank;
(6) the surface treatment film is a carbon-based rigid film;
(7) the top face has a surface roughness Ra of not more than 0.1 μm;
(8) the top face and the peripheral end face are coated with the surface treatment film;
(9) the top face, the peripheral wall face and the peripheral end face are coated with the surface treatment film;
(10) a groove is formed in a circumferential direction on at least one of the peripheral end face and the peripheral wall face; and
(11) the peripheral end face has an outer periphery that is not coated with the surface treatment film.

Further, the present invention provides a method for manufacturing a drawn can. The method comprises: preparing an annular mold with a through hole, having a top face to be brought into contact with a plate material, and a peripheral end face communicated indirectly with the top face, and at least the top face being coated with a surface treatment film; blanking the plate material to form a blank by using the mold as a punch; and drawing subsequently the blank by using the mold as a die.

Effects of the Invention

The mold of the present invention has a peripheral end face communicated indirectly with the top face. Therefore, even if chipping or scaling occurs on the surface treatment film due to strong shearing force applied to the corners of the outer edge of the mold at the time of blanking the metal plate, the peeling of the surface treatment film may be stopped at the peripheral end face without spreading to the area of the surface treatment film on the top face.

BRIEF DESCRIPTION OF THE DRAWINGS

FIG. 1A shows a state before blanking, and FIG. 1B shows a state during blanking;

FIG. 2A is a schematic cross-sectional view showing an example of the mold of the present invention, and FIG. 2B is an enlarged view of part A in FIG. 2A;

FIG. 3A is a schematic cross-sectional view showing another example of the mold of the present invention, and FIG. 3B is an enlarged view of part B in FIG. 3A;

FIG. 4A shows a state before blanking, FIG. 4B shows a state during blanking, FIG. 4C shows a state after blanking and before drawing; and FIG. 4D shows a state during drawing;

MODE FOR CARRYING OUT THE INVENTION

Hereinafter, the mold of the present invention will be explained in detail with reference to the attached drawings. In the present specification, a 'punch' indicates a mold used as a male mold, and a 'die' indicates a mold used as a female mold. Aside of the mold of the present invention on which the metal plate is to be placed is determined as the upper side, and the opposite side is determined as the lower side.

Figure 1A:
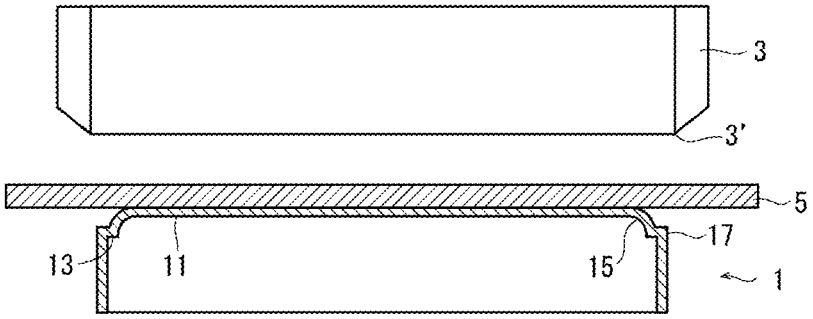
FIGS. 1A and 1B include schematic views showing a process of blanking a metal plate by use of a mold of the present invention: where
Figure 1B:
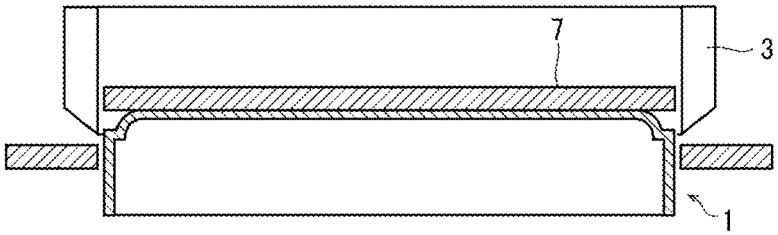

FIG. 1A and FIG. 1B include schematic views showing a process of blanking a plate material such as a metal plate by using the mold of the present invention. FIG. 1A shows a state before blanking the plate material, and FIG. 1B shows a state during blanking the plate material. As understandable from FIGS. 1A and 1B, the mold of the present invention, which is indicated with a sign '1' as a whole, is used in combination with a die 3 for shaping a blank to be drawn, and the mold 1 functions as a punch for shaping a blank to be drawn (hereinafter, this mold 1 may be described simply as a blank-shaping punch). Here, the die 3 that holds a plate material has an opening to correspond to the shape of the blank to be drawn (hereinafter, this die may be described simply as a blank-shaping die 3). Specifically, a plate material 5 is placed on the mold 1 of the present invention (see FIG. 1A), and then, the blank-shaping die 3 is moved downward, or the mold 1 of the present invention is moved upward, thereby blanking the plate material 5 (see FIG. 1B). As a result of this blanking, a blank 7 to be drawn may be obtained.

Figure 2A:
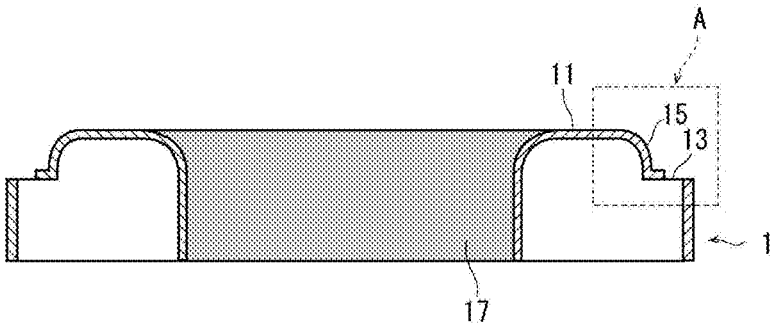
FIGS. 2A and 2B.
Figure 2B:
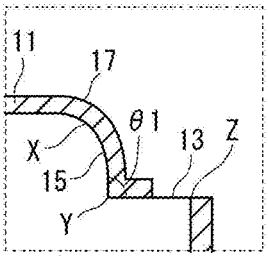

FIGS. 2A and 2B are schematic cross-sectional views showing an example of the mold of the present invention. The mold 1 of the present invention has a top face 11 to be brought into contact with a plate material such as a metal plate (e.g., aluminum plate) to be used for shaping a metal can or the like, and a peripheral end face 13 formed along the outer edge of the mold while communicated indirectly with the top face 11. In the embodiment shown in FIGS. 2A and 2B, the peripheral end face 13 is located lower than the top face 11, and thus, it is communicated indirectly with the top face 11, and a peripheral wall face 15 lies between the top face 11 and the peripheral end face 13. In the present invention, at least the top face 11 is coated with a surface treatment film 17.

There is no particular limitation on the entire shape of the mold 1 of the present invention as long as the outer periphery of the mold 1 corresponds to the shape of the target blank to be drawn. For instance, in a case of drawing the blank to be circular, the outer periphery of the mold 1 also may be formed circular. Further, as described below in detail, in a case of allowing the mold 1 to function not only as a blank-shaping punch but also as a die during drawing, the mold 1 can have a doughnut-shape with a through hole to pass the drawing punch.

Examples of the surface treatment film 17 used to coat at least the top face 11 include a carbon-based rigid film such as a diamond-like carbon (DLC) film and a diamond film, and further, any known surface treatment film such as a ceramic coating film and a fluororesin coating film. Among these films, a carbon-based rigid film tends to be peeled from the mold surface particularly noticeably. Therefore, the present invention may be applied effectively to the carbon-based rigid film, in particular, the diamond film. Here, the diamond-like carbon (DLC) is a generic name for incomplete diamond structure as a mixture of diamond and carbon, and its mixing ratio is not particularly limited.

The surface treatment film 17 has an average thickness usually in a range of 0.1 to 30 μm, and in most cases, 5 to 15 μm. When the surface treatment film is excessively thin, it might be difficult to coat the mold uniformly with the film. When the surface treatment film is excessively thick, the peeling resistance might be degraded.

From the viewpoint of durability, the surface treatment film 17 preferably has Vickers hardness of 2000 or more.

It is preferable that the top face 11 of the mold of the present invention has the surface treatment film 17 which is smooth, and specifically, the surface roughness Ra is 0.1 μm or less. The surface roughness Ra can be measured in compliance with JIS B0601-2001.

FIG. 2B shows that the peripheral wall face 15 is provided downward from the outer edge of the top face 11, and the lower end of the peripheral wall face 15 joins the peripheral end face 13. Preferably, a corner X formed by the peripheral wall face 15 and the top face 11 is slightly rounded to prevent indentation on the blank to be shaped, or to prevent adhesiveness deterioration caused by increase in thickness of the surface treatment film at the corner X. Specifically, it is preferable that the corner X has a radius of curvature of the corner X of 0.1 mm or more.

Figure 5:
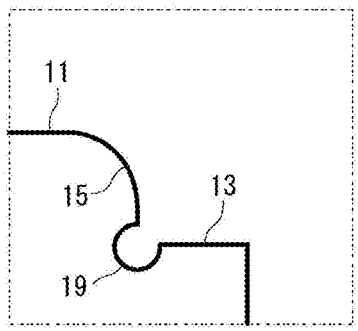
FIG. 5 is a schematic view showing an example of a groove formed on the mold of the present invention.

For a corner Y formed by the peripheral wall face 15 and the peripheral end face 13, it is preferable that the radius of curvature of the corner Y is as small as possible for preventing reliably the surface treatment film from further scaling. Specifically, the radius of curvature of the corner Y is preferably 1 mm or less. The corner Y preferably has also an angle θ1 in a range of 90 to 150° from the viewpoint of processability and from the viewpoint of keeping the maximum surface area of the top face. Further, as shown in FIG. 5, the corner Y may be shaped as a clearance groove. FIG. 5 is a view for conceptually illustrating the shape of the mold in the region from the top face to the peripheral end face, in which the surface treatment film is not shown. The broken line surrounding FIG. 5 indicates that this drawing corresponds to the enlarged view of the part A of FIG. 2A and FIG. 2B or the enlarged view of the part B of FIGS. 3A and 3B. This holds true for FIG. 6 and FIGS. 8 to 10.

Figure 6:
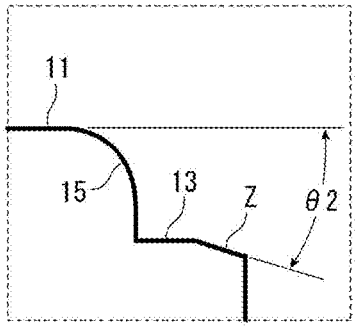
FIG. 6 is a view for illustrating a tilt angle θ2 of a cutting edge in the mold of the present invention.

A corner Z in FIG. 6 is formed by the peripheral end face 13 and the outer edge of the mold 1. Taking the sharpness into consideration, the tilt angle θ2 of the cutting edge with respect to the top face of the mold is preferably 30° or less.

Returning to FIGS. 2A and 2B, the width in the circumferential direction of the peripheral end face 13 may be determined suitably in accordance with the mold size or the like, though preferably, it is 0.1 to 5 mm in average, and particularly preferably 0.3 to 2 mm in average. When the width is excessively small, manufacturing of the mold may be difficult. When the width is excessively large, wrinkles may be caused at the time of drawing.

The difference in height between the surface of the peripheral end face 13 and the top face 11 is preferably in a range of 0.1 to 5 mm, and particularly preferably 0.1 to 2 mm in order to avoid the following problems: a metal plate may be bent during blanking and may be caught between the punch and the die, or an indentation may remain on the metal plate to cause product failure.

The outer periphery on the peripheral end face 13, which serves as a cutting edge, is preferably not covered with the surface treatment film 17 as shown in FIGS. 2A and 2B from the viewpoint of reliably preventing peeling, while it is preferably covered with the surface treatment film 17 as shown in FIGS. 1A and 1B from the viewpoint of processability of the mold. The peripheral wall face 15 may not necessarily be covered with the surface treatment film but preferably covered therewith. It is preferable that the thickness, the hardness and surface roughness of the surface treatment film on the peripheral end face 13 and on the peripheral wall face 15 are respectively within preferred numerical ranges for the thickness, the hardness and surface roughness of the surface treatment film on the top face 11.

In FIGS. 2A and 2B, the lower end of the peripheral wall face 15 joins the peripheral end face 13, and the peripheral end face 13 is located lower than the top face 11. The outer edge of the peripheral end face 13 matches the outer edge of the mold 1 of the present invention.

Figure 7:
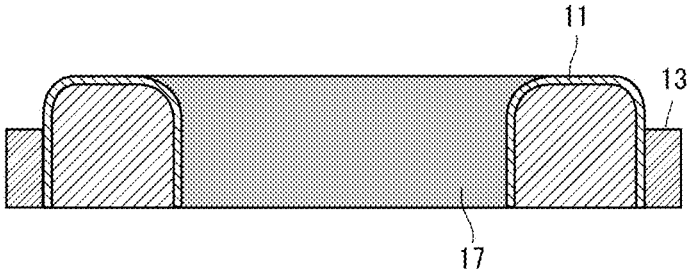
FIG. 7 is a schematic cross-sectional view showing another example of the mold of the present invention.
Figure 8:
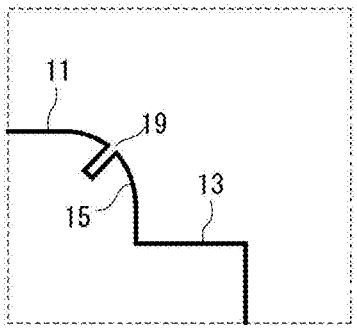
FIG. 8 is a schematic view showing another example of the groove formed on the mold of the present invention.
Figure 9:
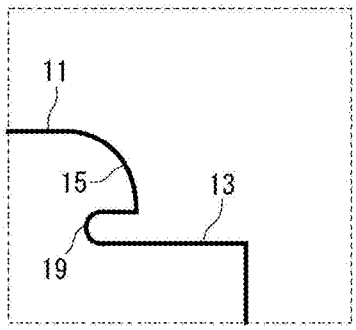
FIG. 9 is a schematic view showing still other example of the groove formed on the mold of the present invention.
Figure 10:
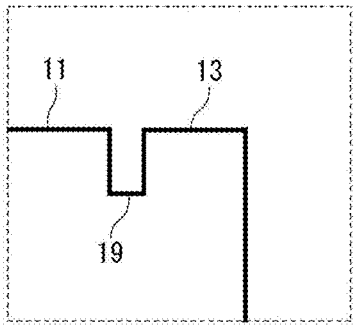
FIG. 10 is a schematic view for illustrating an example of the mold of the present invention, where the top face and the peripheral end face are on the same height.

As shown in FIGS. 1A, 1B, 2A and 2B, the top face 11 and the peripheral end face 13 may be constituted of the same members, or they may be constituted of separate members as shown in FIG. 7. Although the outer edge part (a part corresponding to the peripheral wall face 15) of the member having the top face 11 in FIG. 7 is covered with the surface treatment film, it may not be covered therewith.

The peripheral end face 13 preferably has a shape corresponding to the shape of the outer edge of the mold 1. For instance, when the mold outer edge is circular, preferably the peripheral end face 13 is shaped annular. When the outer edge of the mold is rectangular, the peripheral end face 13 preferably is also shaped as a rectangular ring. As mentioned above, the peripheral end face is provided on the outer edge of the mold, imparting an important feature of the present invention.

In a conventional technique, a mold is coated with a surface treatment film such as a carbon-based rigid film. When the mold is polished or used as a blank-shaping punch, shearing force may be intensively applied to the corners of the outer edge of the mold, thereby causing chipping and scaling of the surface treatment film at the part for coating the mold outer edge corners. Starting from the chipping and scaling, peeling progresses to the remaining part of surface treatment film on the other parts of the mold, thereby shortening the life of the mold. In contrast, in the mold of the present invention, even when chipping or scaling occurs in the surface treatment film at the part covering the outer edge corner of the mold, the peeling of the film is limited to the peripheral end face but it may not spread further. In addition to that, the peripheral end face imposes substantially no influence on the final state of the blank to be drawn. Therefore, with the mold of the present invention, which has a peripheral end face, a high-quality blank to be drawn can be shaped without concern for chipping or scaling of the surface treatment film.

Figure 3A:
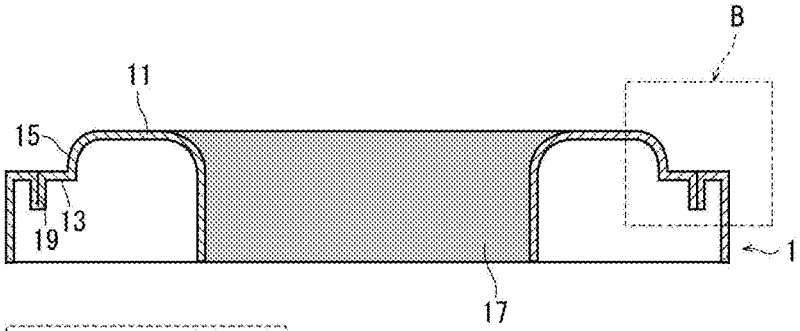
FIGS. 3A and 3B.
Figure 3B:
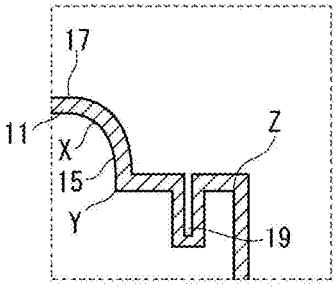

FIGS. 3A and 3B include schematic cross-sectional views showing another example of the mold of the present invention. In a case of providing the surface treatment film 17 on the peripheral end face 13, it is preferable that a groove 19 is formed on the peripheral end face 13. Alternatively, the groove 19 may preferably be formed in a region between the outer edge of the top face 11 and the inner edge of the peripheral end face 13, for instance, on the peripheral wall face 15. In FIGS. 3A and 3B, the groove 19 is formed in a circumferential direction on the peripheral end face 13. By forming the groove 19, it is possible to stop at the groove 19 the progress of peeling of the surface treatment film that has occurred at the outer edge of the peripheral end face. From the viewpoint of processability and strength of the mold, the groove 19 is formed preferably with a distance of 0.2 mm or more from the outer edge of the peripheral end face 13, and it preferably has a depth of not less than 0.05 mm. As shown in FIGS. 3A and 3B, the groove may be formed in any of horizontal, vertical, or oblique directions. Alternatively, it may be a clearance groove as shown in FIG. 5. The groove may have any known sectional shape, such as rectangle, round and V-shape. The number of the grooves is not limited. It may be one, or two or more as long as there remains spacing for working the mold. The groove is preferably formed along the outer periphery from the viewpoint of space saving, though there is no particular limitation thereon. The groove may be formed like a complete ring, or may be partial.

The above descriptions with reference to FIGS. 1A, 1B, 2A, 2B, 3A and 3B and FIGS. 5 to 8 relate to embodiments where the peripheral end faces are located lower than the top faces. The mold of the present invention can take any other embodiments as long as the peripheral end face is communicated indirectly with the top face. Specifically, as conceptually shown in FIG. 10, the peripheral end face 13 may be located on the same height as the top face 11, and a groove 19 may be formed in a region between the top face 11 and the peripheral end face 13, thereby making the peripheral end face be communicated indirectly with the top face. The groove 19 is specified above in detail. In this embodiment, since the peripheral end face 13 and the top face 11 are on the same height, the peripheral end face 13 and the metal plate may be brought into contact with each other during pressing. At that time, if any peeling of the surface treatment film occurred at the peripheral end face, the metal plate might get contact with the mold material, thereby to degrade the lubricity. As a result, the metal plate might be caught on the surface of the mold during drawing. In order to prevent this problem, in a case of locating the peripheral end face 13 and the top face 11 on the same height, preferably for instance a clearance is imparted between the peripheral end face 13 and a drawpad placed direct above in order to avoid applying pressure to the metal plate on the peripheral end face.

A plate material is blanked out to a predetermined shape by use of the mold of the present invention having the aforementioned features, whereby a blank to be drawn is obtained. Specific examples of the plate material to be blanked include a plate of metal such as aluminum, copper, iron or an alloy containing any of these metals, and further a surface-treated steel plate such as a tin-plated steel plate like a tinned steel plate. Similarly to the metal plates, composite plates such as a resin plate, paper, and a fiber sheet can be used preferably. The thus obtained blank to be drawn is then subjected to drawing, and further subjected to bending, ironing or the like if necessary to make a finally shaped article.

As described above, the mold of the present invention is formed in advance with a through hole to pass a drawing punch, so that the mold of the present invention can be used as a punch for shaping a blank to be drawn and further as a drawing die. The mold can be used to conduct blanking and drawing consecutively (hereinafter, this consecutive working may be called blank-drawing), and thus, it has industrial advantages.

Figure 4A:
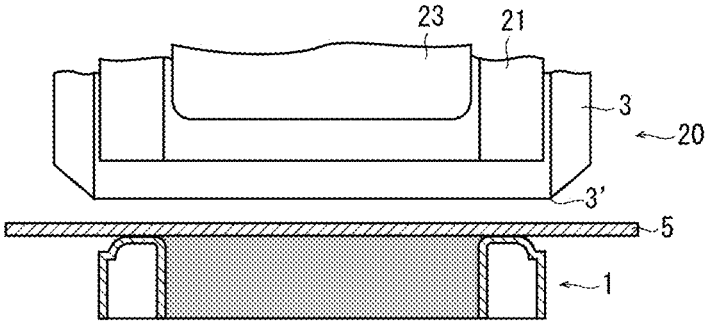
FIGS. 4A to 4D include conceptual diagrams showing a process of blank-drawing by use of the mold of the present invention.
Figure 4B:
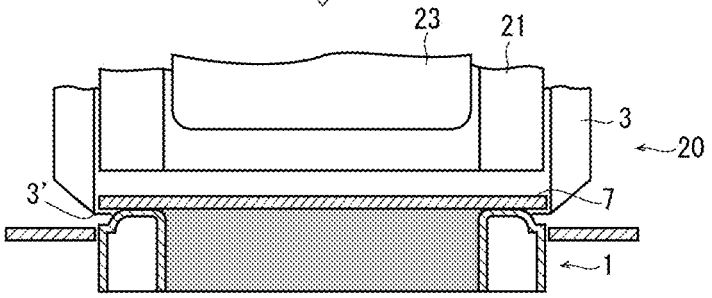
Figure 4C:
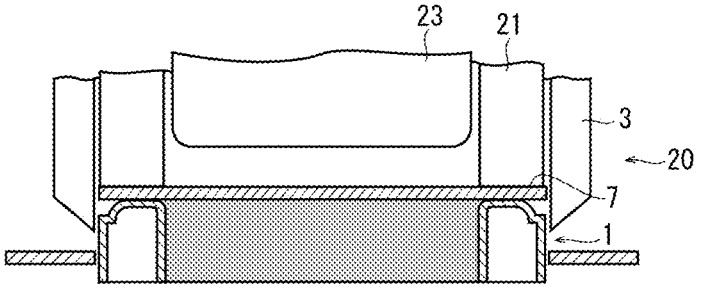
Figure 4D:
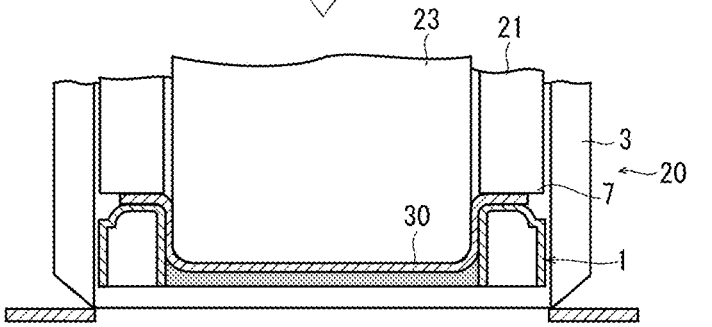

FIG. 4A to 4D include includes conceptual diagrams showing an example of blank-drawing by use of the mold of the present invention. FIG. 4A shows a state before blanking. FIG. 4B shows a state during blanking. FIG. 4C shows a state after blanking and before drawing, and FIG. 4D shows a state during drawing. When the mold of the present invention is used as a blank-shaping punch and also as a drawing die, the blank-drawing is conducted according to the following process, for instance. First, as shown in FIG. 4A, a metal plate 5 is placed on the mold 1 of the present invention. Further, an upper mold 20 comprising a blank-shaping die 3, a drawpad 21 and a drawing punch 23 is prepared. The upper mold is assembled such that the tip end 3' of the blank-shaping die is located the lowest, the drawpad 21 has a bottom face being in contact with the blank and located above the tip end 3' of the blank-shaping die, and the drawing punch 23 has a bottom face being in contact with the blank and located further above the bottom face of the drawpad 21. When this upper mold is moved downward, as shown in FIG. 4B, the tip end 3' of the blank-shaping die of the upper mold 20 arrives at the metal plate 5 and blanks it out to shape a blank 7 to be drawn. At that time, the mold 1 of the present invention functions as a punch for shaping a blank to be drawn. The upper mold is consecutively moved downward, thereby as shown in FIG. 4C, firmly sandwiching the blank 7 with the mold 1 of the present invention and the drawpad 21. Later, as shown in FIG. 4D, the drawing punch 23 is further moved downward to draw the blank 7 to be drawn, thereby obtaining a low-profile drawn can (bottomed cylindrical body) 30.

As mentioned above, when the mold of the present invention is used also as a drawing die, the peripheral end face of the mold may not cause any product failures such as indentations and wrinkles of the obtained drawn cans, as evidently shown in Examples below. Namely, it is possible to obtain a high-quality drawn can by use of the mold of the present invention as the blank-shaping punch and also as the drawing die.

The mold of the present invention can be manufactured by any conventional manufacturing method as long as at least the top face is coated with the surface treatment film and the mold has a peripheral end face.

The mold is manufactured by, for instance, preparing a substrate of any known material, and the substrate is worked to have a desired shape. In the working, the thickness of the surface treatment film is taken into consideration.

Specific examples of the materials for the substrate include: a cemented carbide alloy obtained by sintering a mixture of tungsten carbide (WC) and a metal binder such as cobalt; and a cermet obtained by sintering a mixture of a metal carbide such as titanium carbide (TiC) or a titanium compound such as titanium carbonitride (TiNC) and a metal binder such as nickel or cobalt.

Next, the surface treatment film is formed by use of any known film formation process suitable for the composition of the surface treatment film, and the surface of the film may be polished as required by any known method.

For instance, when the surface treatment film is a diamond film, the film may be formed by any known method such as a plasma CVD method like a microwave plasma CVD method or a high frequency plasma CVD method, or a hot filament CVD method. The plasma CVD method is carried out in the following manner. For preparing the material gas, a hydrocarbon gas such as methane, ethane, propane, or acetylene is diluted with a hydrogen gas. This material gas may be mixed suitably with a small amount of gas such as oxygen, carbon monoxide, or carbon dioxide in order to adjust the film quality and film formation rate. The substrate is heated using the material gas, so that plasma is generated by microwave, high frequency or the like. The material gas is decomposed in the plasma to generate active species, and to grow diamond crystals on the substrate, whereby a diamond film can be formed.

In a case where the surface treatment film is a DLC film, the film can be formed by any known film formation methods such as a high frequency plasma CVD method, an ECRCVD method, an ICP method, a DC sputtering method, an ECR sputtering method, an ionization vapor deposition method, an arc vapor deposition method, a laser vapor deposition method, an electron beam vapor deposition method, and a resistance heating vapor deposition method. In the high frequency plasma CVD method, for instance, a glow discharge generated by the high frequency between electrodes decomposes the material gas (hydrocarbon gas such as methane) to form a DLC film on the substrate.

In a case of not coating the peripheral wall face with the surface treatment film in the present invention, the aforementioned film formation may be carried out after masking the region corresponding to the peripheral wall face. Alternatively, the surface treatment film on the peripheral wall face may be removed after formation of the surface treatment film. The same holds true for a case where the peripheral end face is not coated with the surface treatment film.

After formation of the surface treatment film, the surface of the mold is polished if necessary by any known method, whereby the mold of the present invention is manufactured.

EXAMPLES

Hereinafter, the present invention will be explained with reference to Experimental Examples below.

In these Experimental Examples, the surface roughness and waviness were measured by the methods as described below. Namely, arithmetic mean roughness Ra and the maximum height waviness Wz were measured by using a surface texture and contour measuring instrument (SURFCOM 2000SD3 supplied by TOKYO SEIMITSU CO., LTD.) and in compliance with JIS-B-0601.

The mold to be subjected to the experiment was prepared by coating diamond on a substrate of cemented carbide alloy by a hot filament CVD method.

Experimental Example 1

Diamond films were provided on a conventional mold without peripheral end face (hereinafter, this may be called simply a conventional mold) and on a mold with peripheral end face of the present invention (hereinafter, this may be called simply as a mold of the present invention). The molds were coated completely with the films, excepting the bottom parts. Some regions (i.e., top face and the inner diameter part) to be brought into contact with the metal plate were polished with a grindstone containing diamond abrasive grains until the arithmetic mean roughness Ra became 0.03 μm.

The thus obtained molds have shapes as described below.

Conventional mold and mold of the present invention;

Outer diameter: 140 mm

Inner diameter: 90 mm

Average thickness of surface treatment film 17: 10 μm

Mold of the present invention;

Radius of curvature of corner X: 0.2 mm

Radius of curvature of corner Y: 0.1 mm

Angle of corner Y: 90°

Width in circumferential direction of peripheral end face 13: 0.5 mm

Difference in height between surface of peripheral end face 13 and top face 11: 0.2 mm Distance between groove 19 and outer edge of peripheral end face 13: 0.25 mm Depth of groove 19: 0.1 mm In the conventional mold without peripheral end face, chipping occurred at the outer edge corner of the mold during polishing. When polishing was continued further, peeling of the diamond film progressed from the chipped part. In contrast, neither chipping nor peeling occurred in the mold having a peripheral end face, namely, the mold of the present invention.

Experimental Example 2

Figure 11:
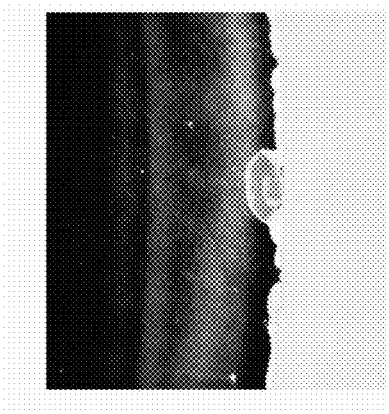
FIG. 11 is a photograph showing a site in the vicinity of a peripheral end face of a conventional mold after blank-drawing a metal plate in Experimental Example 2.
Figure 12:
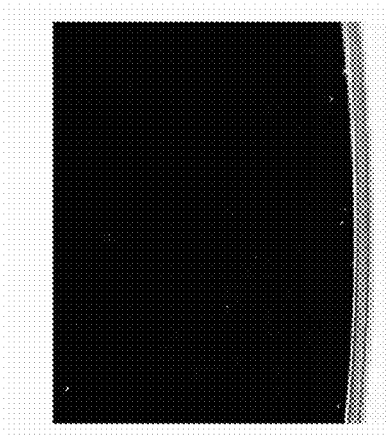
FIG. 12 is a photograph showing a site in the vicinity of the peripheral end face of the mold of the present invention after blank-drawing a metal plate in Experimental Example 2.

A metal plate was blanked and drawn by use of the mold that had been polished in Experimental Example 1. As the metal plate, A3104 material having a plate thickness of 0.27 mm was used. As shown in FIG. 11, chipping and peeling occurred at the outer edge corner of the conventional mold at the time of blanking, and peeling of the diamond film progressed from the chipping or the peeling when the working was continued. Furthermore, fragments adhered to the drawn can, and scratches were observed. As shown in FIG. 12, chipping occurred in the mold of the present invention. However, even when the working was continued, peeling was stopped at the peripheral end face and it did not progress further. Further, no fragments adhered to the drawn can.

Experimental Example 3

The maximum height waviness Wz in the vicinity of the open end of each of the drawn cans obtained in Experimental Example 2 was measured to evaluate the wrinkles of the drawn cans. The values were about 1.6 μm in both the conventional mold and the mold of the present invention. The peripheral end face did not cause any wrinkles.

EXPLANATIONS OF LETTERS OR NUMERALS

1 mold
3 blank-shaping die
3' tip end of die
5 metal plate
7 blank
11 top face
13 peripheral end face
15 peripheral wall face
17 surface treatment film
19 groove
20 upper mold
21 drawpad
23 drawing punch
30 drawn can

The invention claimed is:

1. A mold applicable to blanking of a plate material for shaping a blank to be drawn and to drawing the blank, said mold being an annular mold with a through hole to pass a drawing punch, comprising:

(i) a top face to be brought into contact with the plate material and a peripheral end face, and wherein (ii) a peripheral wall face is provided downward from an outer edge of the top face, the peripheral end face being connected to the top face by the peripheral wall face, (iii) a lower end of the peripheral wall face joins the peripheral end face, (iv) a corner formed by the peripheral wall face and the outer edge of the top face is rounded, (v) a diameter of an outer edge of the peripheral end face and a diameter of an outer edge of the mold are the same, and the diameter of the outer edge of the mold corresponds to a diameter of the blank to be drawn, and (vi) at least the top face is coated with a diamond film, wherein the outer edge of the peripheral end face is a cutting edge for blanking the plate material.

2. The mold according to claim 1, wherein a groove is formed in a region between the outer edge of the top face and an inner edge of the peripheral end face.

3. The mold according to claim 1, wherein the top face and the peripheral end face are constituted of separate members.

4. The mold according to claim 1, wherein the top face has a surface roughness Ra of not more than 0.1 μm.

5. The mold according to claim 1, wherein the top face and the peripheral end face are coated with the diamond film.

6. The mold according to claim 1, wherein the top face, the peripheral wall face and the peripheral end face are coated with the diamond film.

7. The mold according to claim 6, wherein a groove is formed in a circumferential direction on at least one of the peripheral end face and the peripheral wall face.

8. The mold according to claim 1, wherein the peripheral end face has an outer periphery that is not coated with the diamond film.

9. A method for manufacturing a drawn can, comprising the steps of:

(i) preparing the mold according to claim 1, (ii) using the mold as a punch to blank a plate material to form a blank, and (iii) subsequently using the mold as a die to draw the blank with the drawing punch.

* * * * *